US010945539B2

(12) United States Patent
Standen et al.

(10) Patent No.: US 10,945,539 B2
(45) Date of Patent: Mar. 16, 2021

(54) MERCHANDISE DISPLAY FIXTURE

(71) Applicant: ShurTech Brands, LLC, Avon, OH (US)

(72) Inventors: Brian Standen, Medina, OH (US); Christopher J. Longstreet, Avon Lake, OH (US); James A. Williams, Strongsville, OH (US); Charles D. Fernberg, Bedford Heights, OH (US); James C. Monroe, Avon, OH (US)

(73) Assignee: ShurTape Technologies, LLC, Hickory, NC (US)

( * ) Notice: Subject to any disclaimer, the term of this patent is extended or adjusted under 35 U.S.C. 154(b) by 58 days.

(21) Appl. No.: 16/224,529

(22) Filed: Dec. 18, 2018

(65) Prior Publication Data

US 2019/0223627 A1 Jul. 25, 2019

Related U.S. Application Data

(60) Provisional application No. 62/599,855, filed on Dec. 18, 2017.

(51) Int. Cl.

| | |
|---|---|
| ***A47F 1/12*** | (2006.01) |
| ***A47F 5/00*** | (2006.01) |
| ***A47F 7/00*** | (2006.01) |
| ***A47F 5/10*** | (2006.01) |
| ***A47F 3/14*** | (2006.01) |

(Continued)

(52) U.S. Cl.

CPC ..... *A47F 7/005* (2013.01); *A47B 46/00* (2013.01); *A47B 57/581* (2013.01); *A47F 1/121* (2013.01); *A47F 1/126* (2013.01); *A47F 3/14* (2013.01); *A47F 5/101* (2013.01); *A47F 5/105* (2013.01); *A47F 5/13* (2013.01); *A47F 5/132* (2013.01); *A47B 96/061* (2013.01); *A47F 5/103* (2013.01)

(58) Field of Classification Search

CPC ..... A47F 7/005; A47F 1/121; A47F 1/126; A47F 5/101; A47F 5/105; A47F 5/13; A47F 5/132; A47F 3/14; A47B 57/581; A47B 46/00

See application file for complete search history.

(56) References Cited

U.S. PATENT DOCUMENTS 5,862,923 A * 1/1999 Nordquist ..... A47F 1/121 211/59.2
5,992,651 A * 11/1999 Shaw ..... A47F 5/13 211/59.2

(Continued)

FOREIGN PATENT DOCUMENTS

DE 9108404 U1 * 9/1991 ..... A47F 7/17
FR 2791539 A1 * 10/2000 ..... A47F 7/17

*Primary Examiner* — Kimberley S Wright
(74) *Attorney, Agent, or Firm* — Fay Sharpe LLP

(57) ABSTRACT

A display for tape products. The display includes at least x shelves disposed on a stand. At least y modules are provided, wherein y>x. Each module includes a plurality of interconnected frame channels. The modules comprise at least first modules including channels of a first width and second modules including channels of a second width. At least several of the modules include reversible generally U-shaped inserts configured for insertion into the channels. The U-shaped inserts provide a first open orientation suitable for receiving a generally cylindrical tape product and a second closed orientation suitable for supporting a rectangular tape product.

20 Claims, 17 Drawing Sheets

(51) Int. Cl.

| | |
|---|---|
| ***A47F 5/13*** | (2006.01) |
| ***A47B 57/58*** | (2006.01) |
| ***A47B 46/00*** | (2006.01) |
| *A47B 96/06* | (2006.01) |

(56) References Cited

U.S. PATENT DOCUMENTS

| | | | | |
|---|---|---|---|---|
| 6,332,547 | B1 * | 12/2001 | Shaw | A47F 1/12 211/59.2 |
| 6,478,167 | B1 * | 11/2002 | Burgess | A47F 1/12 211/59.2 |
| D545,092 | S * | 6/2007 | Knorring, Jr. | A47F 1/12 D8/377 |
| 9,351,592 | B2 * | 5/2016 | Wilke | A47B 57/045 |
| 2002/0166827 | A1 * | 11/2002 | Robolin | A47F 7/28 211/74 |
| 2006/0032827 | A1 * | 2/2006 | Phoy | A47F 5/0093 211/59.2 |
| 2006/0283819 | A1 * | 12/2006 | Larsen | A47F 5/005 211/59.2 |
| 2014/0091696 | A1 * | 4/2014 | Welker | A47F 5/0043 312/408 |

* cited by examiner

MERCHANDISE DISPLAY FIXTURE

BACKGROUND

The present exemplary embodiments relate to a merchandise display fixtures. It finds particular application in conjunction with an adhesive tape display and will be described with particular reference thereto. However, it is to be appreciated that the present exemplary embodiment is also amenable to other like applications.

A wide variety of display systems have been provided in the retail sector for displaying various products to potential consumers. Retail stores frequently arrange product packages, for both storage and display, side-by-side along shelves disposed on a vertical display stand. This traditional arrangement style can be problematic because the storage capacity of the display is limited. In retail stores, product packages are usually stored by placing packages in front of/behind one another. Accordingly, the storage capacity of the display stand is limited by its depth in proportion to the thickness of the product package. Accordingly, a need in the art exists for a display unit and storage arrangement that provides the customer with a direct line of sight of the product while maximizing product storage per area of floor space.

Furthermore, because display space is limited, providing a display stand with adjustability to accommodate different product sizes is desirable. Moreover, it may be desirable to reconfigure a display space to accommodate larger quantities of a fast selling item. Similarly, a display system that can be easily adjusted based on seasonality would be desirable.

However, conventional merchandise display systems are often constructed to accommodate a fixed arrangement of products using product specific wall and shelving solutions. As a result of the limited flexibility of conventional merchandise display systems, retail entities may be incapable of efficiently adapting to new product packaging or display configurations with their existing hardware/fixture inventory. Disclosed herein are systems and methods for arranging product packages in a flexible manner.

BRIEF DESCRIPTION

Various details of the present disclosure are hereinafter summarized to provide a basic understanding. This summary is not an extensive overview of the disclosure and is neither intended to identify certain elements of the disclosure, nor to delineate scope thereof. Rather, the primary purpose of this summary is to present some concepts of the disclosure in a simplified form prior to the more detailed description that is presented hereinafter.

According to a first embodiment, a display for tape products is provided. The display includes at least x shelves disposed on a stand. At least y modules are provided, wherein y>x. Each module includes a plurality of interconnected frame channels. The modules comprise at least first modules including channels of a first width and second modules including channels of a second width. At least several of the modules include reversible generally U-shaped inserts configured for insertion into the channels. The U-shaped inserts provide a first open orientation suitable for receiving a generally cylindrical tape product and a second closed orientation suitable for supporting a rectangular tape product. The display optionally further includes removable spring-loaded pusher elements configured for disposition in at least several of the channels, at least one cabinet configured for mounting to the stand, and at least one module including a relatively long front leg and a relatively short rear leg.

In accordance with another embodiment of the present disclosure, an adjustable merchandising shelf system for displaying and storing retail products is provided. The system includes a plurality of interchangeable modules wherein each module includes at least one interconnected frame channel, a first side wire edge and a flange portion located on an opposed second side. The flange portion includes a flange channel configured to engage a first side wire edge of an adjacent module. The system also includes a reversible generally U-shaped insert configured for insertion into the at least one channel, said U-shaped insert providing a first open orientation suitable for receiving a generally cylindrical product and a second closed orientation suitable for supporting a rectangular or other flat sided tape product.

BRIEF DESCRIPTION OF THE DRAWINGS

The invention consists in the novel parts, construction, arrangements, combinations and improvements, shown and described. The accompanying drawings, which are incorporated in and constitute a part of the specification illustrate one embodiment of the invention and together with the description, serve to explain the principles of the invention.

DETAILED DESCRIPTION

Figure 1:
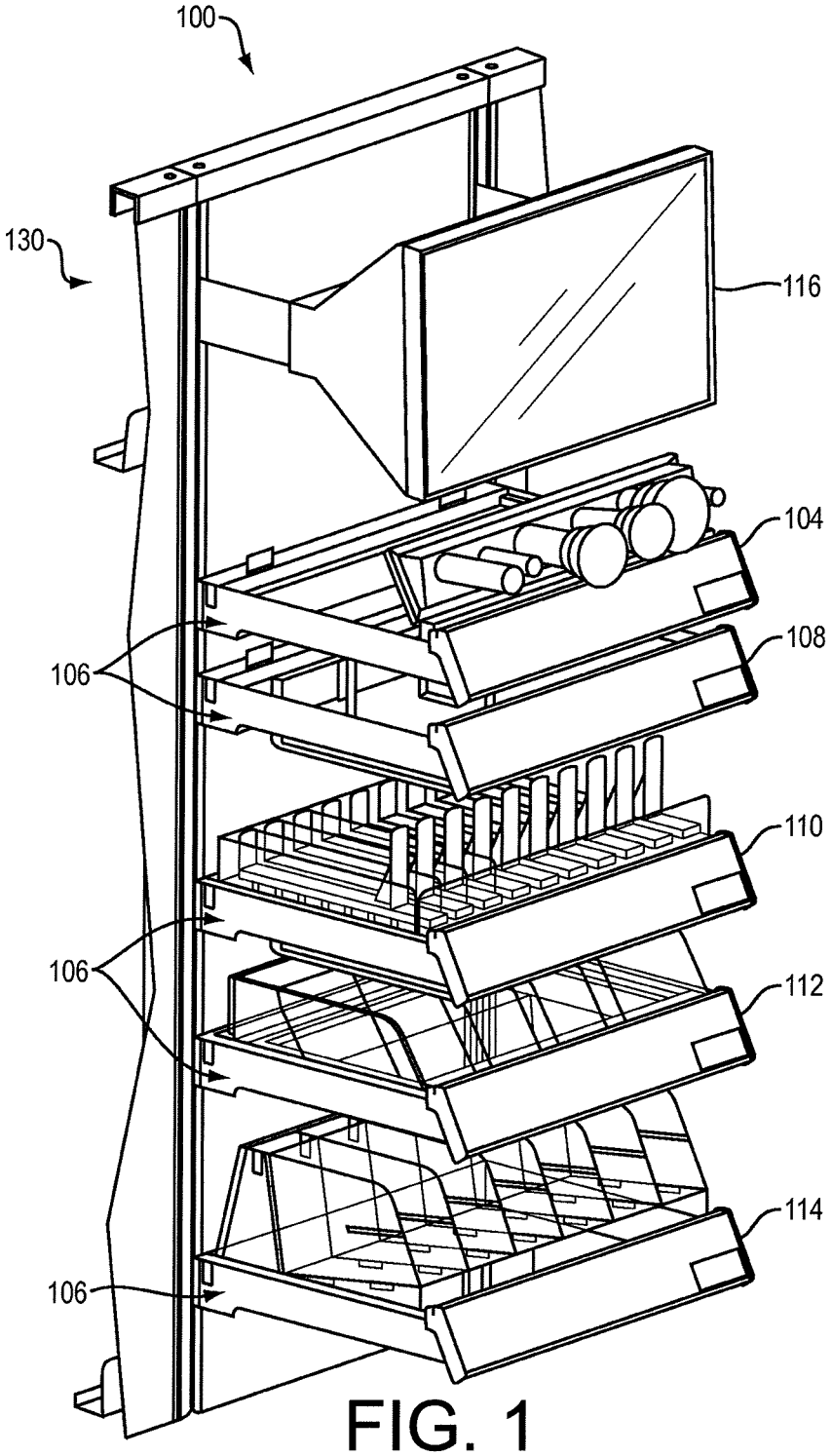
FIG. 1 (Prior Art)
FIG. 1 is a perspective view of a prior art merchandising display system.

A more complete understanding of the articles/devices, processes and components disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings and are not intended to define or limit the scope of the disclosure. In the drawings and the following description below, it is to be understood that like numeric designations refer to components of like function.

The singular forms "a, "an," and "the" include plural referents unless the context clearly dictates otherwise.

As used in the specification and in the claims, the term comprising may include the embodiments "consisting of" and "consisting essentially of." The terms "comprise(s)," include(s)," "having," "has," "can," "contain(s)," and variants thereof, as used herein, are intended to be open-ended transitional phrases, terms, or words that require the presence of the named ingredients/steps and permit the presence of other components/steps. However, such description should be construed as also describing compositions or processes as "consisting of" and "consisting essentially of" the enumerated components/steps, which allows the presence of only the named components/steps along with any unavoidable impurities that might result therefrom and excludes other ingredients/steps.

Products are presented to consumers in various ways at retail stores. Some products are presented on shelves. Some products are presented on pegs. Some products are presented in other ways. Many retail stores are organized with parallel shelves or other product supporting structures. Aisles are disposed between the product support structures. Consumers walk along the aisles and select the products they wish to purchase from the product support structures on the two sides of the aisles. Most retailers want to present products to consumers in an orderly, attractive manner.

It is advantageous to display products in a proper orientation near the front of the product containing structures where they can be easily seen by the consumer. It is also advantageous to have products easily removed from the product containing structures by the consumer. It is also advantageous to contain a large number of products in the product containing structures whereby adequate variety and stock for the consumer are presented.

Certain products pose unique problems for display. For example, products such as adhesive tape come in different sizes and for different applications. Nonetheless, it is desirable for a retailer to display these products in a single display. This complicates the display requirements because the display structure, historically, cannot be easily reconfigured to tailor the relative quantity of one product to another.

The present disclosure is generally directed to an adhesive tape display structure including modular and reconfigurable shelf assemblies. The display structure includes shelves which can be mounted to a standard vertical support structure having one or more cross bars mounted to two or more vertical uprights. The present disclosure further describes interchangeable modules received on the shelves.

Exemplary embodiments of the present disclosure overcome the limitations and disadvantages of conventional merchandise display systems, which are often constructed to accommodate a fixed arrangement of products using product specific wall and shelving solutions. While some conventional merchandise display systems provide limited flexibility, the components of such systems can be bulky and the process for rearranging the display systems can be cumbersome and time consuming. As a result of the limited arrangements and flexibility of conventional merchandise display systems, retail entities may be incapable of adapting or incapable of efficiently adapting to new product packaging, display configurations or adjusting relative quantities of product on display with their existing hardware/fixture inventory thereby increasing the size and cost of the hardware/fixture inventory maintained by the retail entity. Exemplary embodiments of the present disclosure overcome the limitations and disadvantages of conventional merchandise display systems by supporting modular components that can be assembled to accommodate different product dimensions and/or product packaging and can provide a flexibility to reconfigure the merchandise display system.

U.S. Pat. No. 9,782,018, herein incorporated by reference, provides one example of a modular wall assembly. FIG. 1 depicts reconfigurable shelf assemblies 106 that can be mounted to a vertical assembly 130 to form a merchandise display system 100. Each of the shelf assemblies 106 can be configured to hold or display retail products in a retail environment. The merchandise display system 100 includes various configurations of the shelf assemblies 106 including a brush display shelf assembly 104, a peg hook shelf assembly 108, a divider tray shelf assembly 110, a Bon Bon tray shelf assembly 112, a trim tray shelf assembly 114 and a lamp 116. One or more of the reconfigurable shelf assemblies 106 can be mounted to the vertical support structures 132 in one or more configurations to form the merchandise display system 100.

The merchandise display system 100 can have a reconfigurable arrangement allowing for one or more of the shelf assemblies 106 to be reset, removed or rearranged, either as a group or independent of one another. Reconfiguration may be used to adapt to new product displays or to adapt to retail facility resets. The shelf assemblies 106 can be adjustably spaced along the assembly 130. For example, the shelf assemblies 106 may be attached to the vertical support structure 132 with uniform spacing between the shelf assemblies 106 or may be attached to the vertical support structure 132 with different or variable spacing. The merchandise display system 100 of FIG. 1, however, suffers from a shortcoming in that adjustability of the product display configuration on an individual shelf is not feasible.

Figure 2:
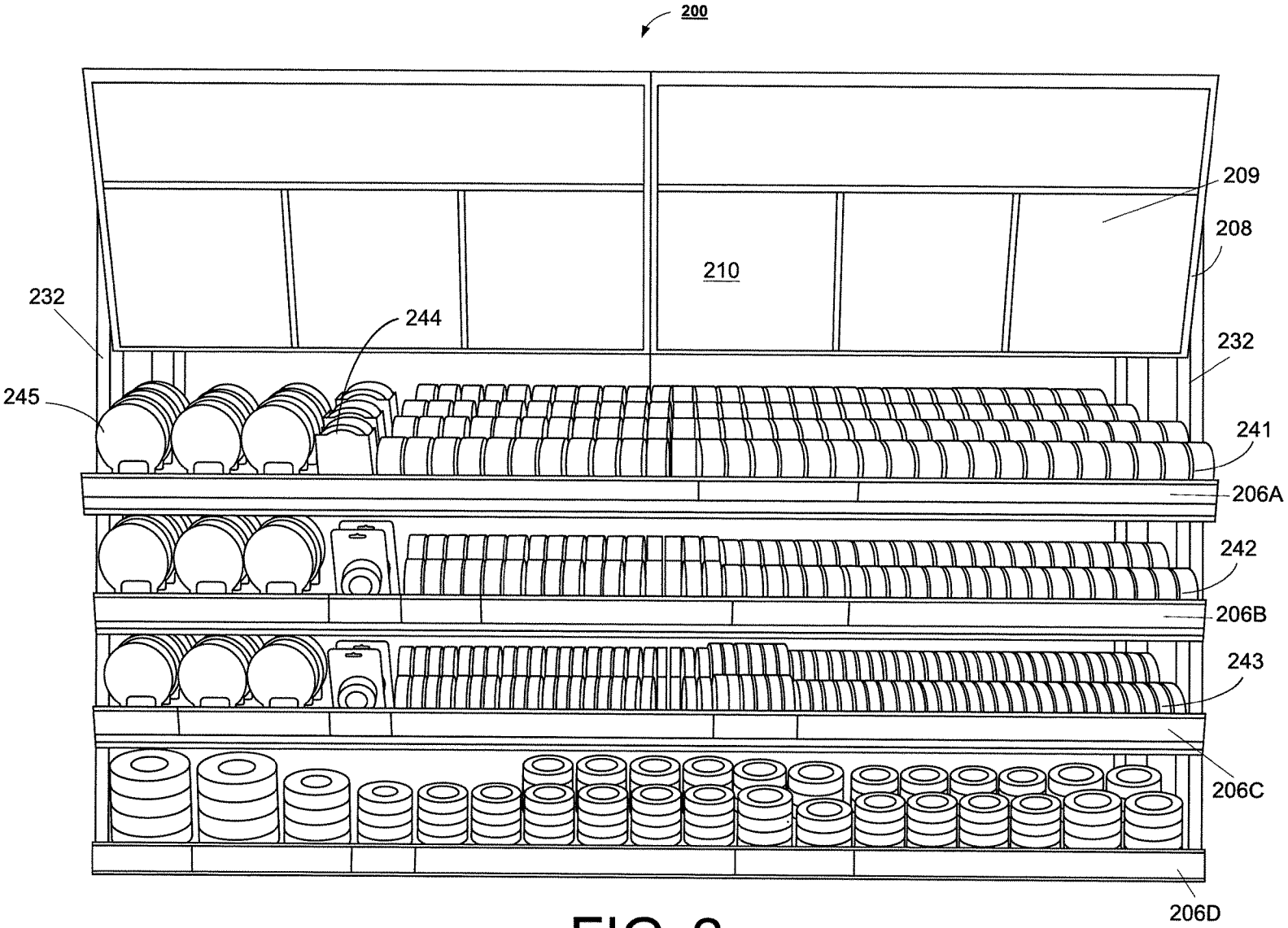
FIG. 2 is a front view of one embodiment of the present display system.
Figure 3:
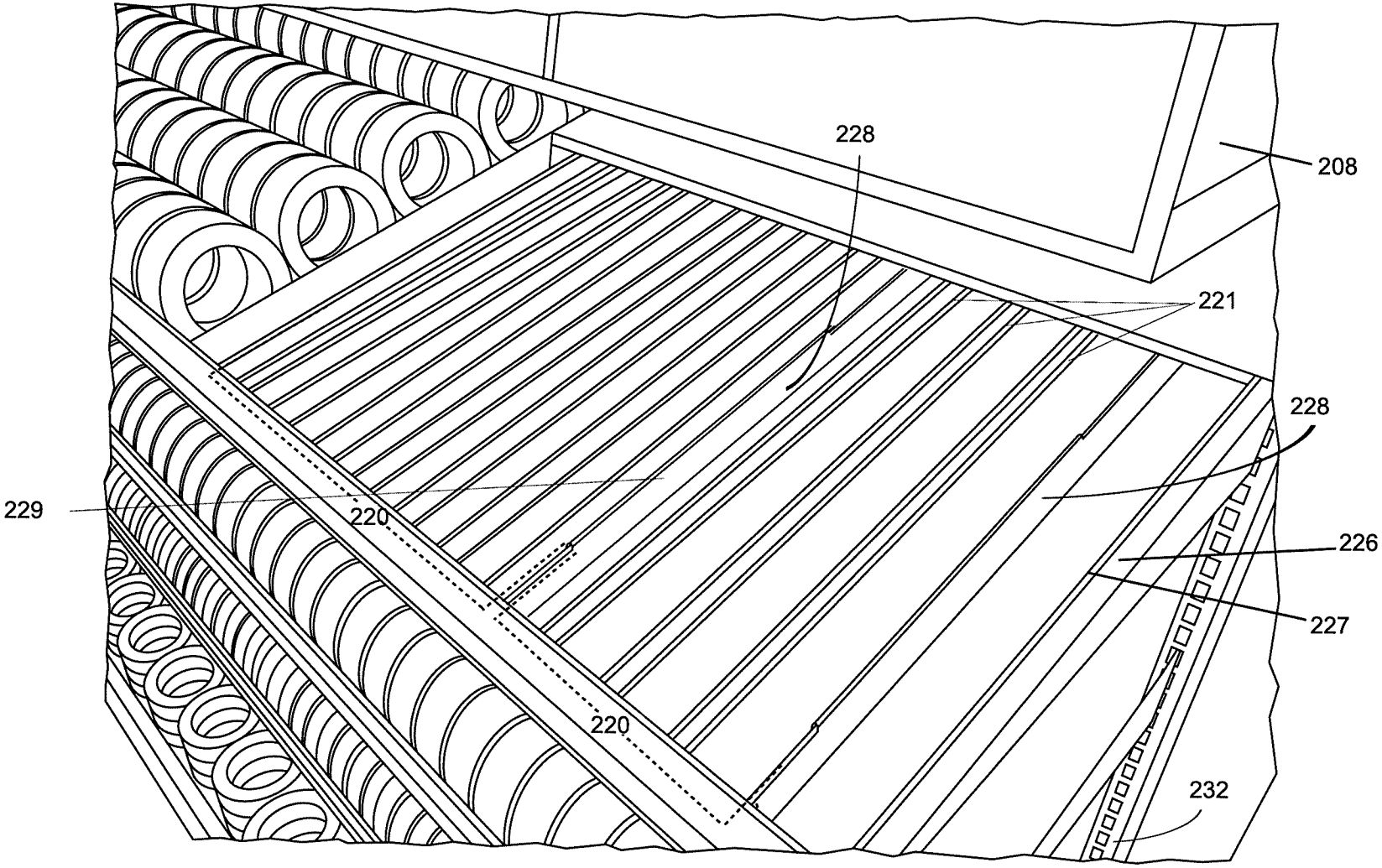
FIG. 3 is a close-up side perspective view of the display system of FIG. 2 with certain products removed.
Figure 4:
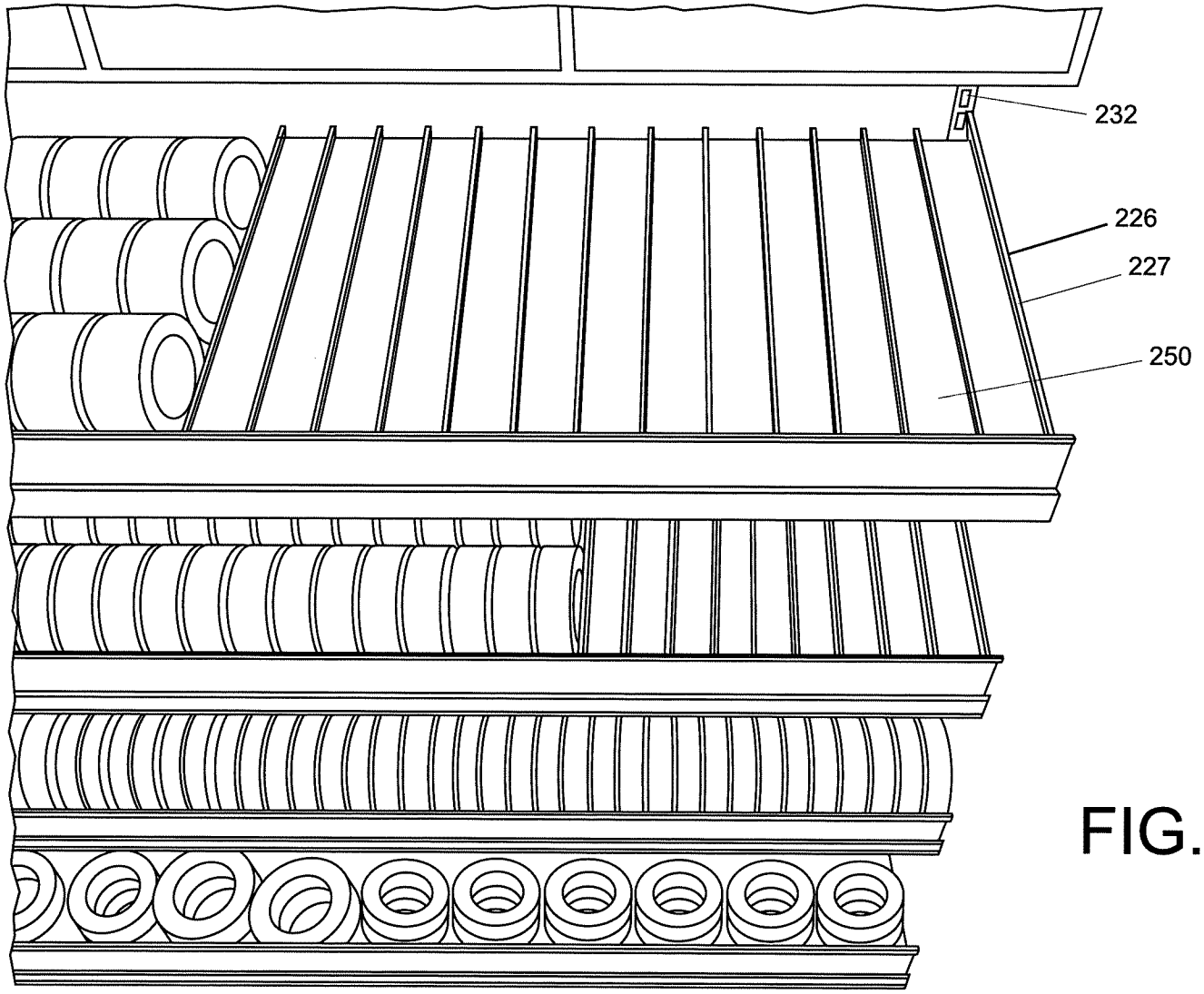
FIG. 4 is a close-up front view of FIG. 2.

With reference to FIGS. 2-4, an embodiment of the present disclosure is depicted. More particularly, an adhesive tape display system 200 is illustrated. The adhesive tape display system 200 includes a plurality of shelves 206A-D (generally referred to as 206) mounted to vertical stands 232 in a manner similar to the illustration of FIG. 1. The shelves 206A-D are oriented to include an inclination downward from the vertical orientation of the vertical stands 232. In some embodiments, the inclination is about for 10° or less. In other embodiments, the inclination is about 10° or greater. While only 4 shelves 206A-D are illustrated, it is to be appreciated that any number of shelves may be mounted to the vertical stands 232.

With continued reference to FIGS. 2-4, a plurality of display modules 220 are placed on the shelves 206A-D as described herein below. The display modules 220 provide a variety of shapes and orientations suitable for receiving tape packages of various widths and configurations. In some embodiments, a display module is configured to display and store sideways orientated cylindrical products. For example, the right portion of the top shelf 206A in FIG. 2 displays sideways oriented rows of tape 241 having a width of 1.88", the right side of the second shelf 206B displays sideways oriented tape 242 of 1.41" width, and the third shelf 206C displays sideways oriented tape 243 of 0.94" width.

In some embodiments, the present adhesive tape display system 200 further includes a mechanism which can accommodate the storage and display of generally rectangular shaped tape packaging 244. In some embodiments, the adhesive tape display system 200 further includes a plurality of modules 220 configured to receive and display forward facing cylindrical tape products 245. In some embodiments, the adhesive tape display system 200 further includes a cabinet 208 removably mounted to the vertical stand 232 and providing hinged doors 209 which can be opened to access a storage area. As depicted, the cabinet hinged doors 209 further include a surface 210 upon which advertising or product instructional information can be displayed.

Turning next to FIGS. 5-10, the structure of the wire frame storage modules 220 are more clearly depicted as modules 220A-220E. FIGS. 5, 6, 7, 8, and 9 illustrate modules having one, two, three, four, and five module channels 250, respectively. The module channels 250 of each module are parallel to the length L of the module 220. In some embodiments, the width W of the module 220 varies to accommodate a plurality of module channels 250. For example and without limitation, module 220A of FIG. 5 has a channel width D1 and module 220C of FIG. 7 has a channel width of D2. The channel width D1, D2 is configured to accept a product of similar width such as those widths associated with rolls of tape 241-243. It is to be appreciated that the channel widths, D1, D2 may be any desirable width. Furthermore, while modules 220A-220E show modules having one to five module channels 250, it is to be appreciated that a module may include any more than five module channels 250.

Figure 5:
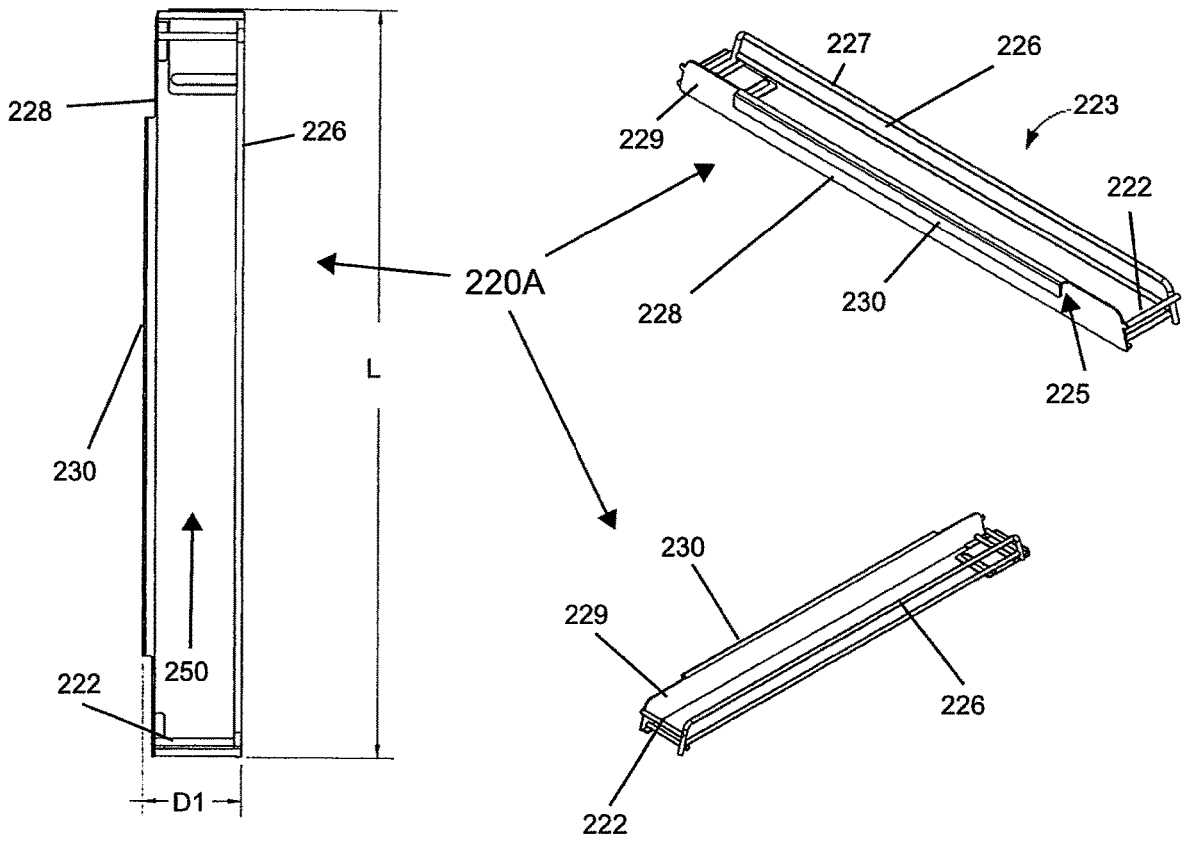
FIG. 5 provides a plurality of views of a single channel side facing cylindrical package module.
Figure 6:
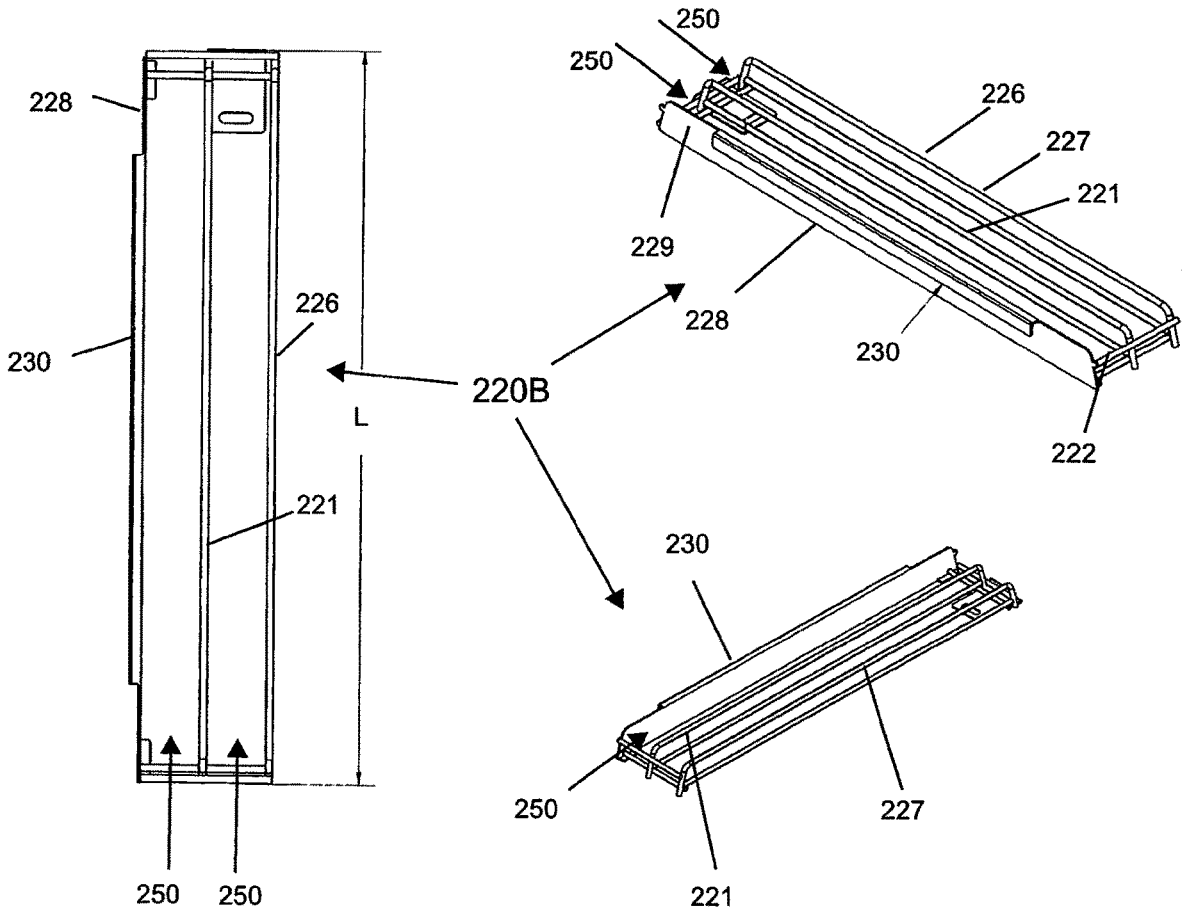
FIG. 6 provides a plurality of views of a two channel side facing package module.
Figure 7:
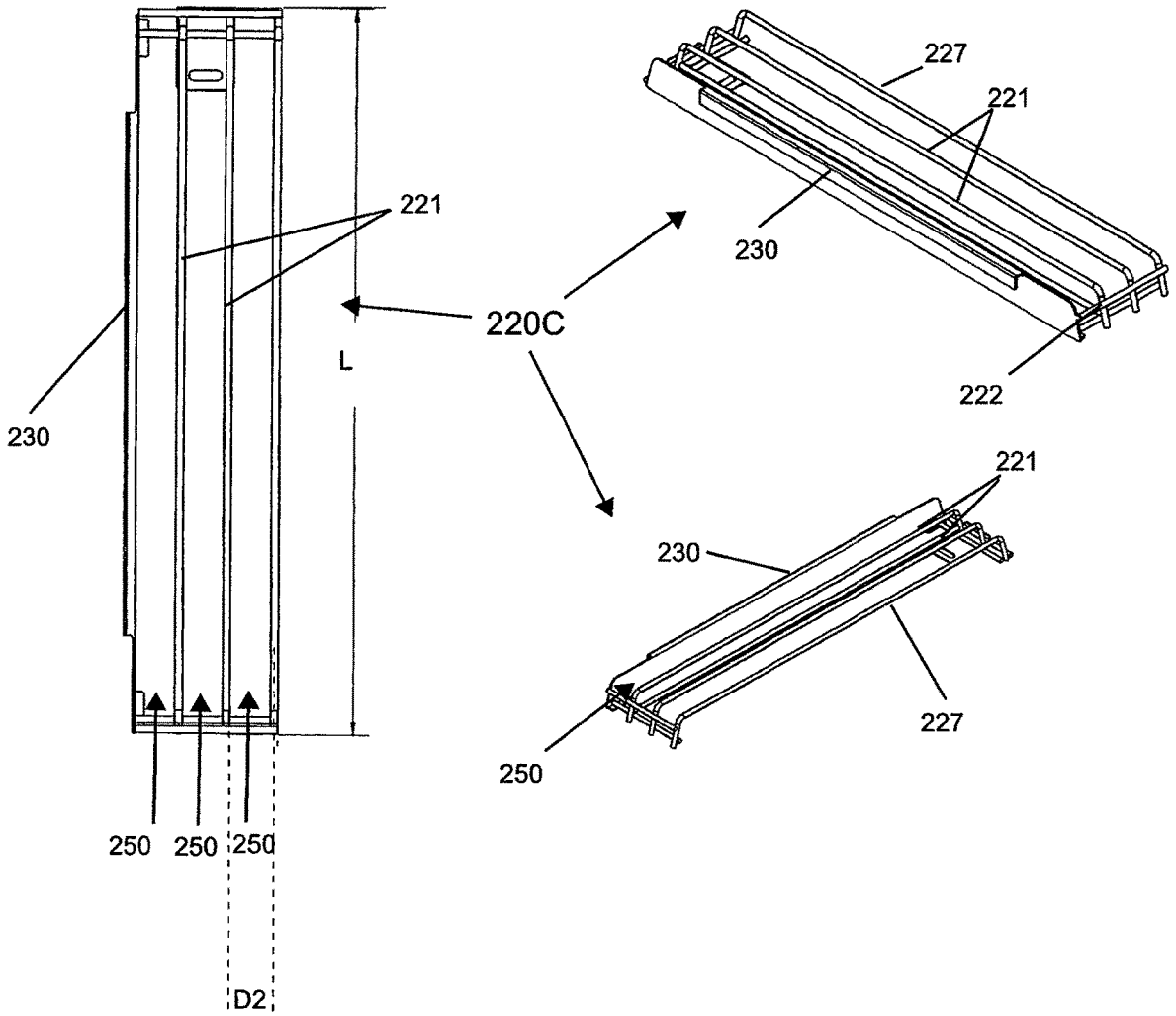
FIG. 7 provides a plurality of views of a three channel side facing cylindrical package module.
Figure 8:
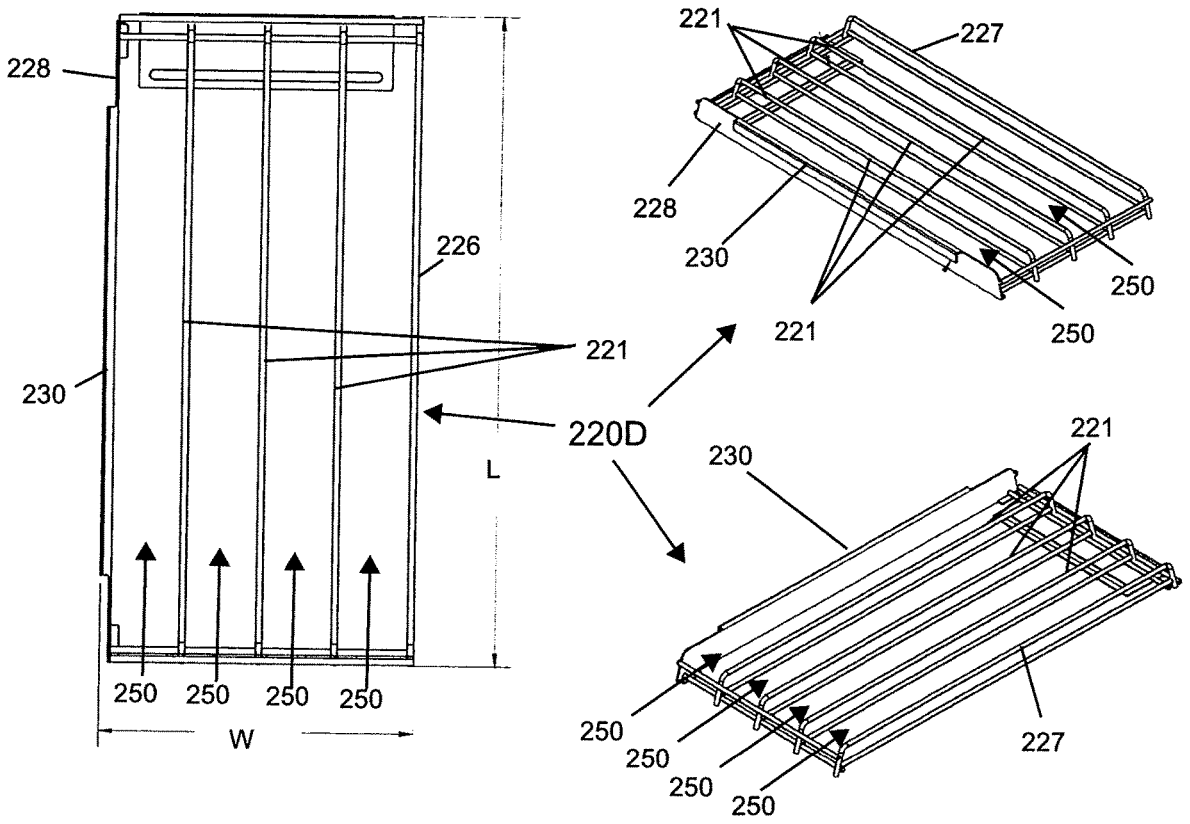
FIG. 8 provides a plurality of views of a four channel side facing cylindrical package module.
Figure 9:
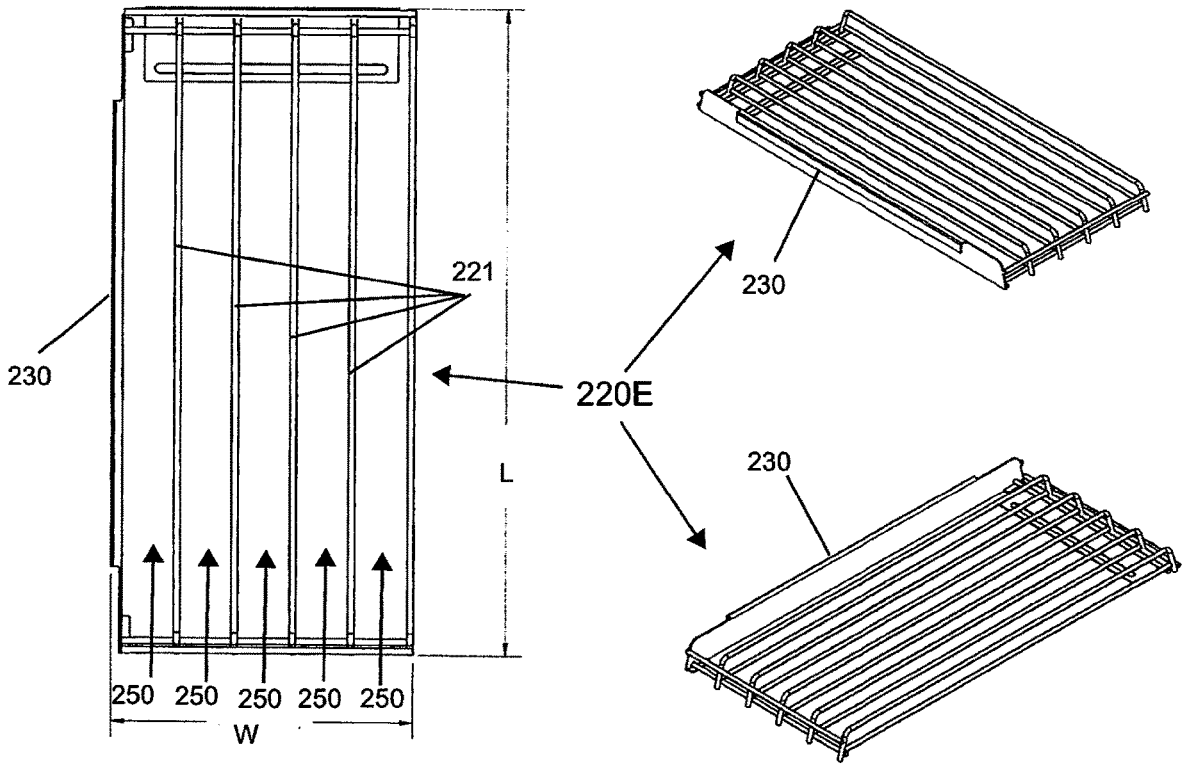
FIG. 9 provides a plurality of views of a five channel side facing cylindrical package module.

The wire framing of the module 220A-220E can be connected by welds to form an integral monolithic body 223. As illustrated in FIGS. 6-8, the modules 220B-E can include a plurality of wire rails 221 defining the module channels 250 in which sideways facing tape rolls 241, 242, 243 can be positioned. As shown in FIG. 5, a module channel 250 is defined between wire rail 227 and the opposed side 228, described in greater detail below.

In some embodiments, a module 220 includes a first side 226 having a wire edge 227 and an opposed side 228 having a sheet metal edge 229. In certain embodiments, the sheet metal edge 229 can include a flange 230 forming a channel 225 configured to receive the wire edge 227 of an adjacent module. This mating of adjacent modules is most clearly illustrated in FIG. 10.

Figure 10:
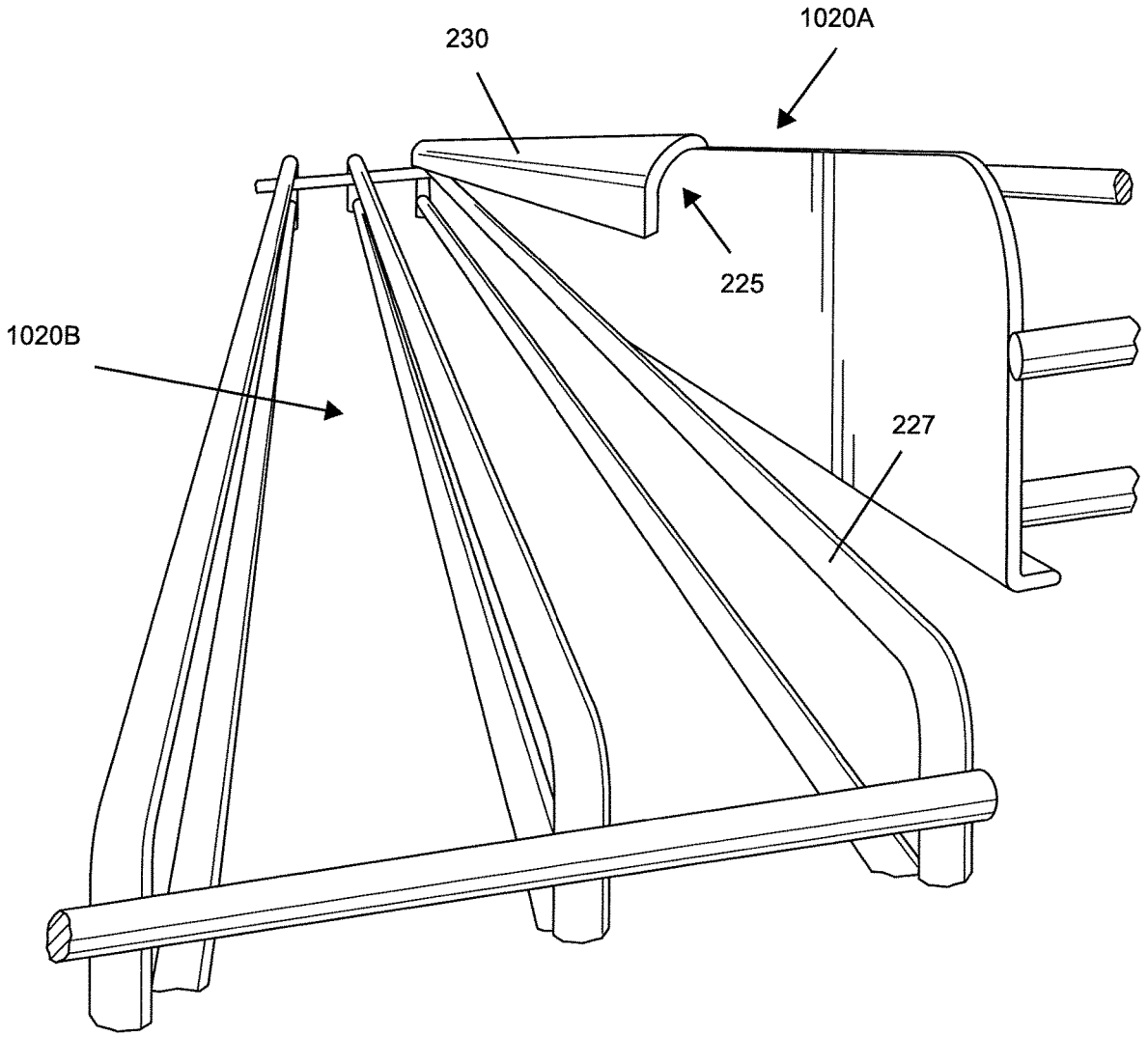
FIG. 10 is a front view of the module interlocking configuration.

In FIG. 10, module 1020A is mated with module 1020B. That is, the flange 230 of module 1020A mates with the wire edge 227 of module 1020B, wherein the wire edge engages the channel 225 of the flange 230. Of course, the module 1020B could have opposed sheet metal edges, although, only one side (either 226 of module 1020B or 228 of module 1020A) needs to include the flange 230 for interconnection of the adjacent modules, 1020A and 1020B.

In some embodiments, and with reference back to FIG. 5, a module 220 can include wire rails 221 and front rails 222 having a height less than a width of the channels 250 of the module 220. In this manner, a cylindrical tape product can be received in the channel 250 and readily removed by a customer. The front rails 222 can have a height less than the wire rails 221 to further improve ease of product removal. Similarly, in certain embodiments, it may desirable for the channel forming rails 221 to have a height less than the height of the sheet metal edge 229 and opposed wire frame edge 227.

In certain embodiments, at least several modules are of a substantially equal width but have different width channels 250. This allows modules 220 to be interchanged on the available shelf space to display more or less of a particular width tape product. For example, if desired by the retail establishment a 1" channel module can be substituted for a 1½" channel module to display more 1" tape product. Since modules are of common perimeter dimensions, reconfiguration of the overall shelf display system 200 is not required.

Figure 11:
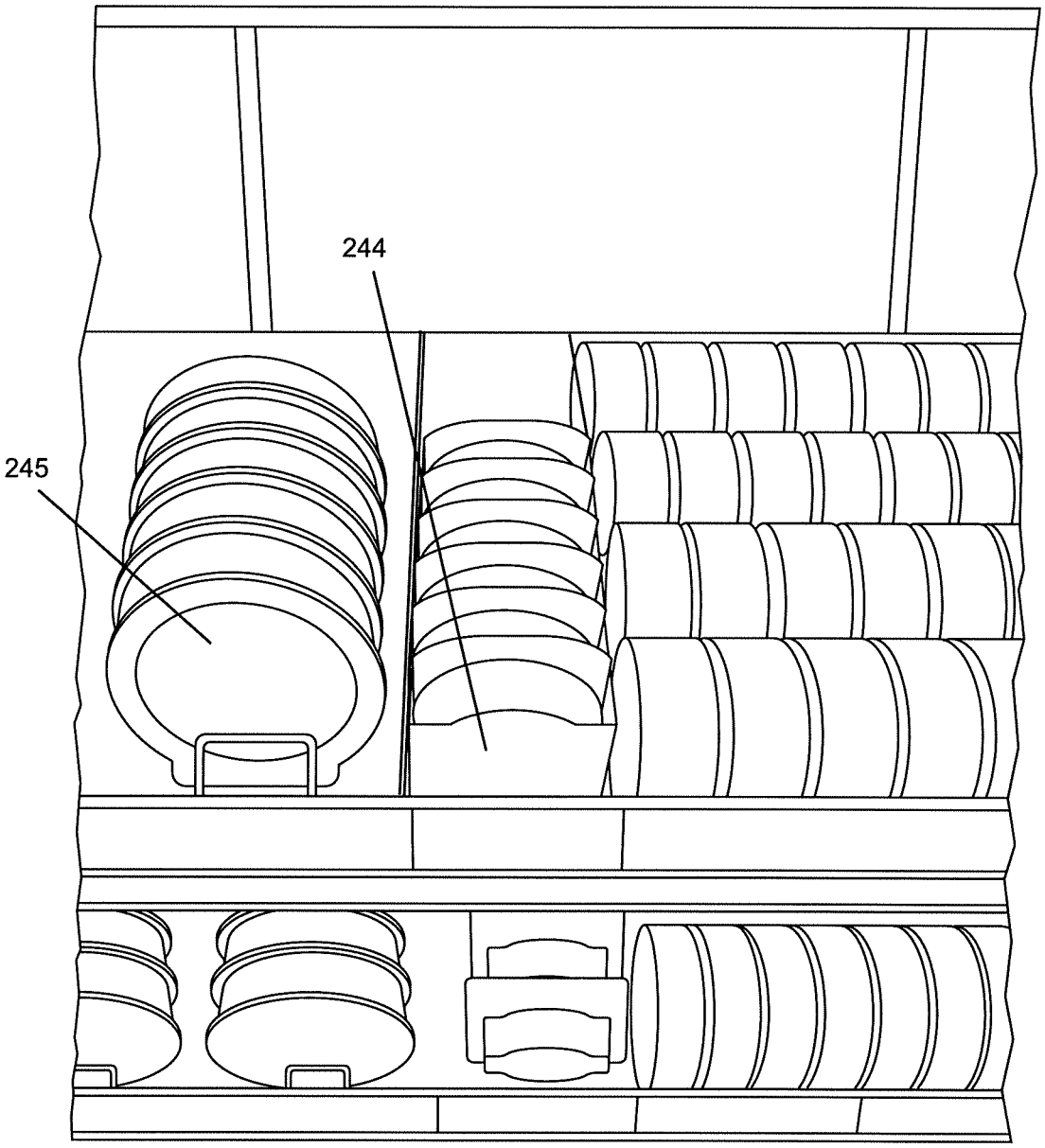
FIG. 11 is a close-up front view of FIG. 2 showing various product configurations which can be displayed in different orientations use the present display system, including front facing cylindrical, side facing cylindrical, and front facing rectangular.
Figure 12:
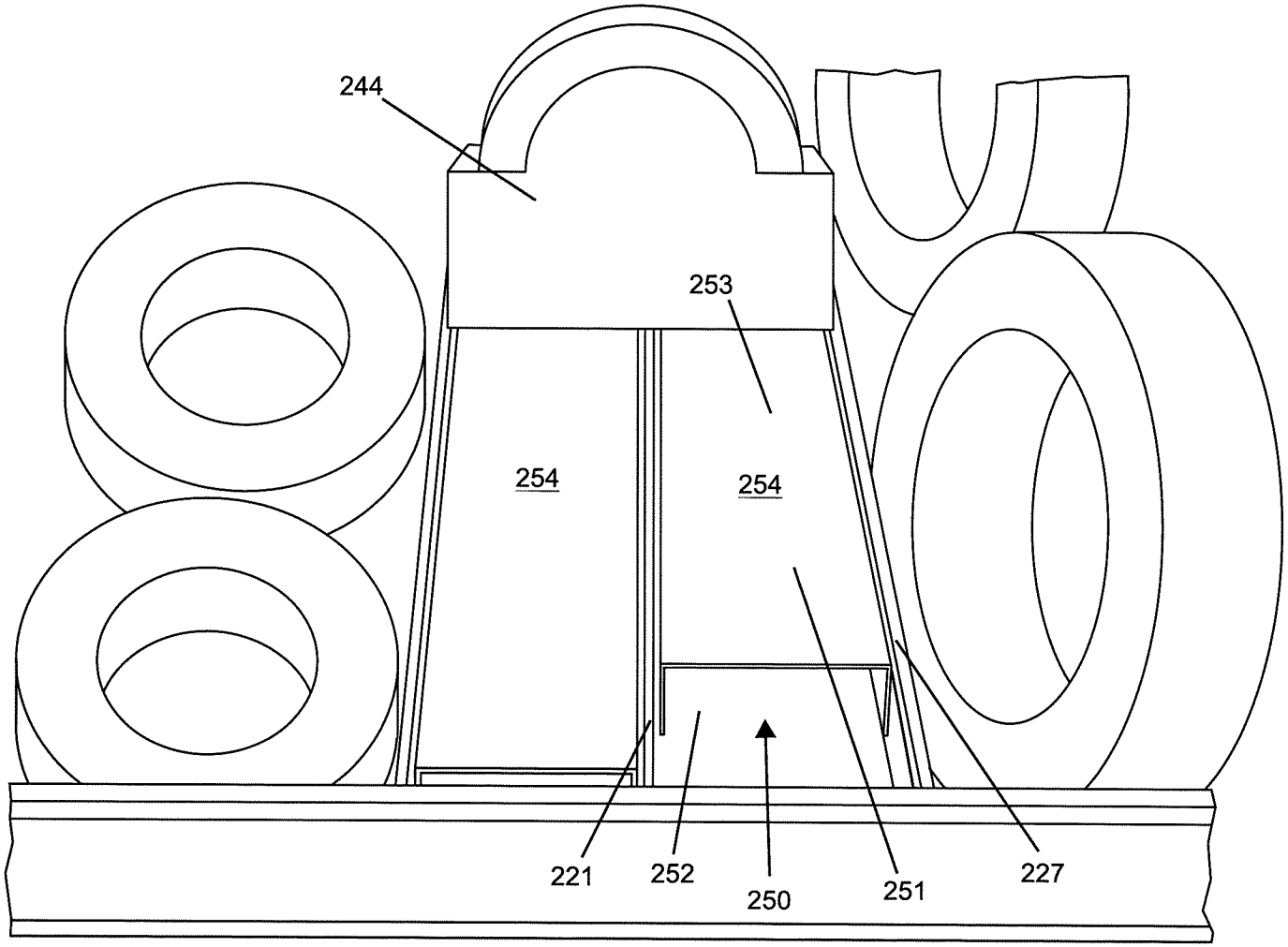
FIG. 12 is a close-up of rectangular package support inserts.
Figure 13:
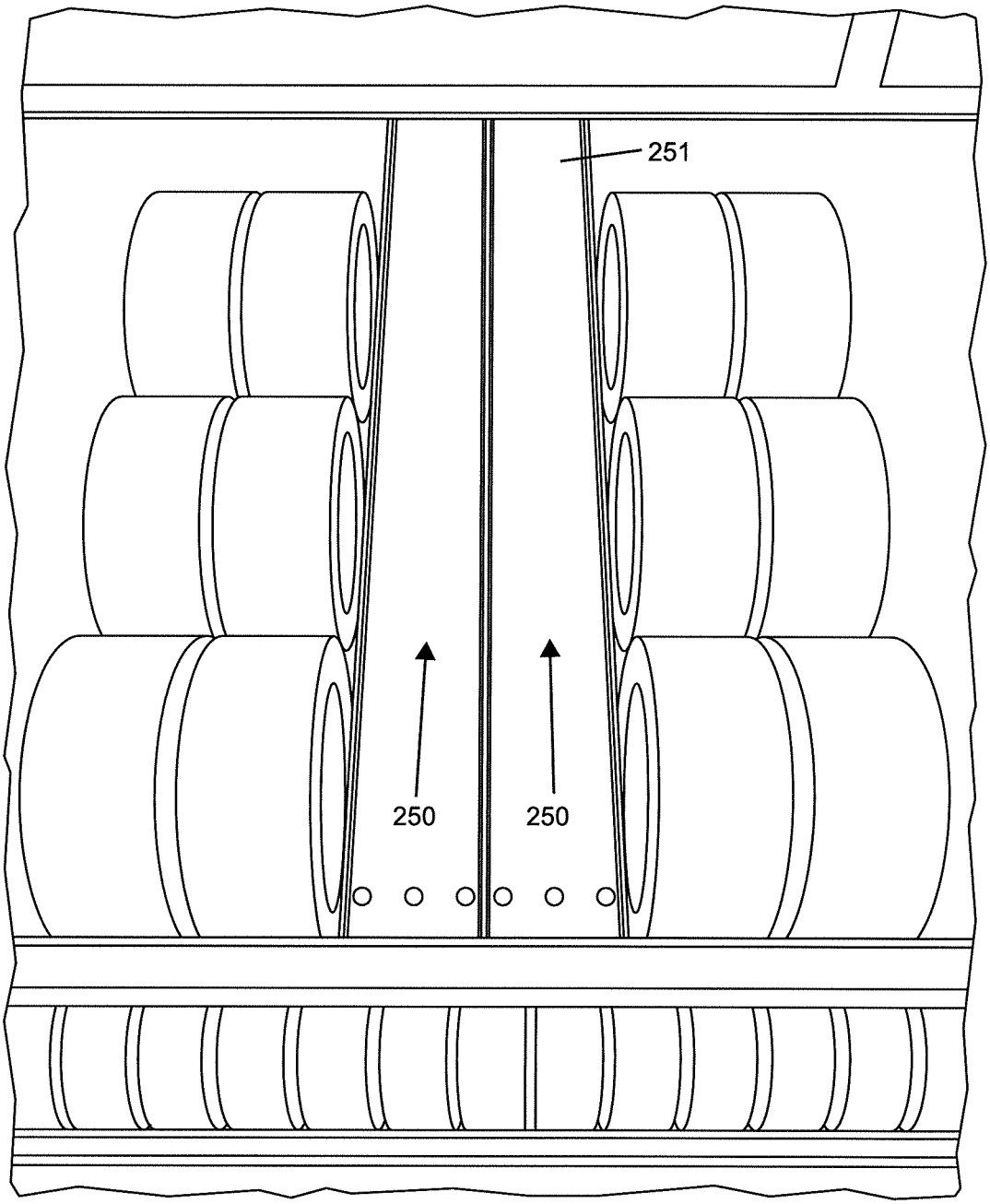
FIG. 13 provides a perspective view of the U-shaped channel inserts configured to receive cylindrical product.
Figure 14:
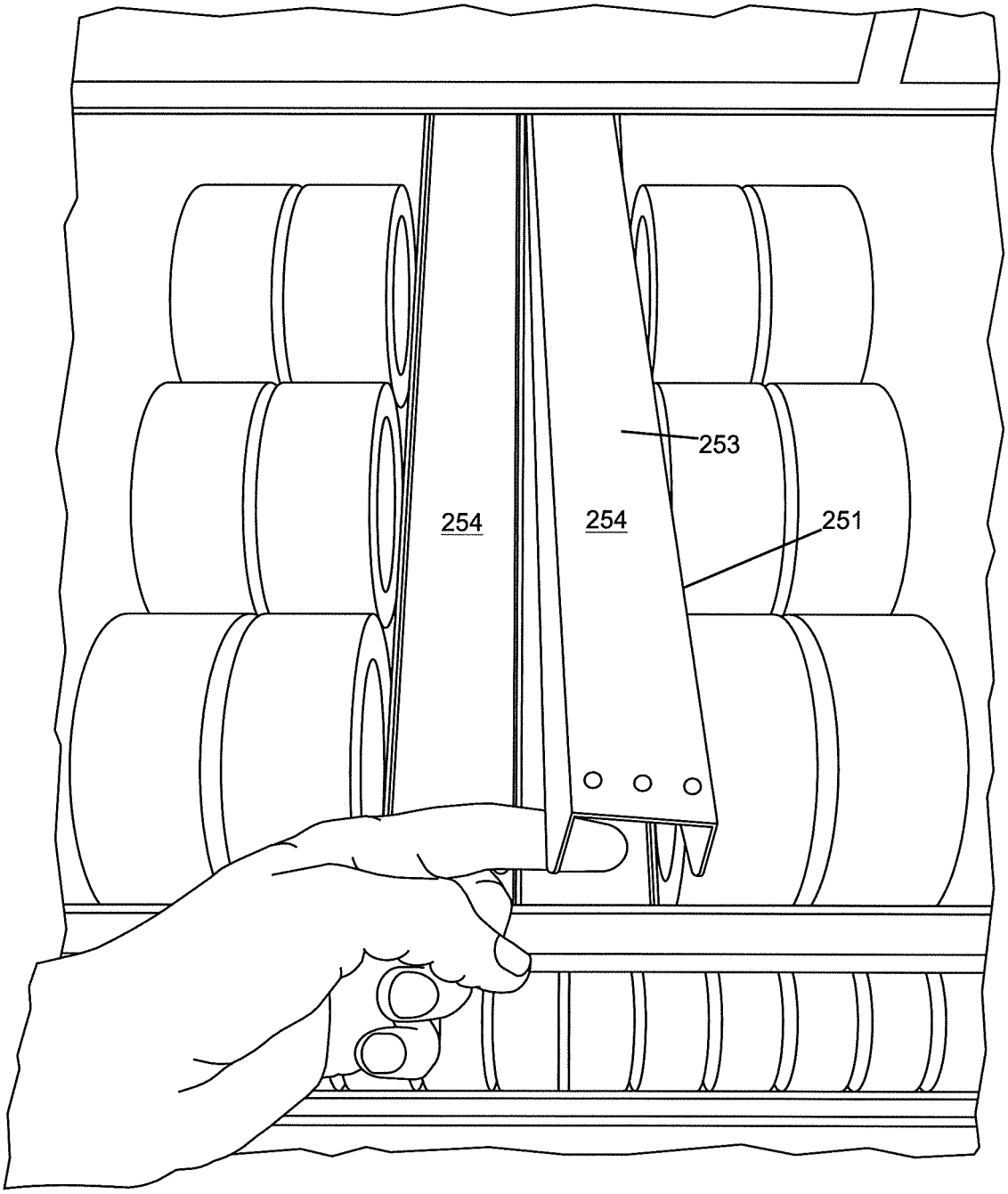
FIG. 14 depicts the reversibility of the insert of FIG. 13 to a rectangular shaped product display configuration.

With reference now to FIGS. 11-13, a pair of wire rails 221 and 227 define a module channel 250 configured to accommodate an elongated generally U-shaped insert 251. The generally U-shaped insert 251 can be oriented with its open end 252 facing upwards such that the module channel 250 formed by the pair of rails 221 and 227 is sufficient to receive a sideways facing cylindrical tape product such as tapes 241, 242, 243. As shown in FIG. 13, the U-shaped insert 251 with an open top orientation is suitable for receiving cylindrical product. FIG. 14 demonstrates the ease with which the U-shaped insert 251 orientation can be reversed.

With reference now to FIGS. 11, 12 and 14, the U-shaped insert 251 can also be inverted such that a closed end 253 forms a substantially flat surface 254 that is suitable for receiving and displaying products having a rectangular or other flat configuration, such as products 244. In certain embodiments, the U-shaped inserts 251 will have a substantially similar height to the height of the rails 221 forming the channel 250 such that the U-shaped insert(s) 251 in combination with the rails 221 can form an extended planar surface.

In some embodiments, a plurality of channels 250 can further be outfitted with a spring-loaded pusher element to facilitate the urging of a display product to a forward position in the channel 250. Preferably, the spring-loaded pusher element is selectively detachable from the module 220. This is analogous to the pusher element 360 of FIG. 15 wherein the pusher element is described in greater detail.

Figure 15:
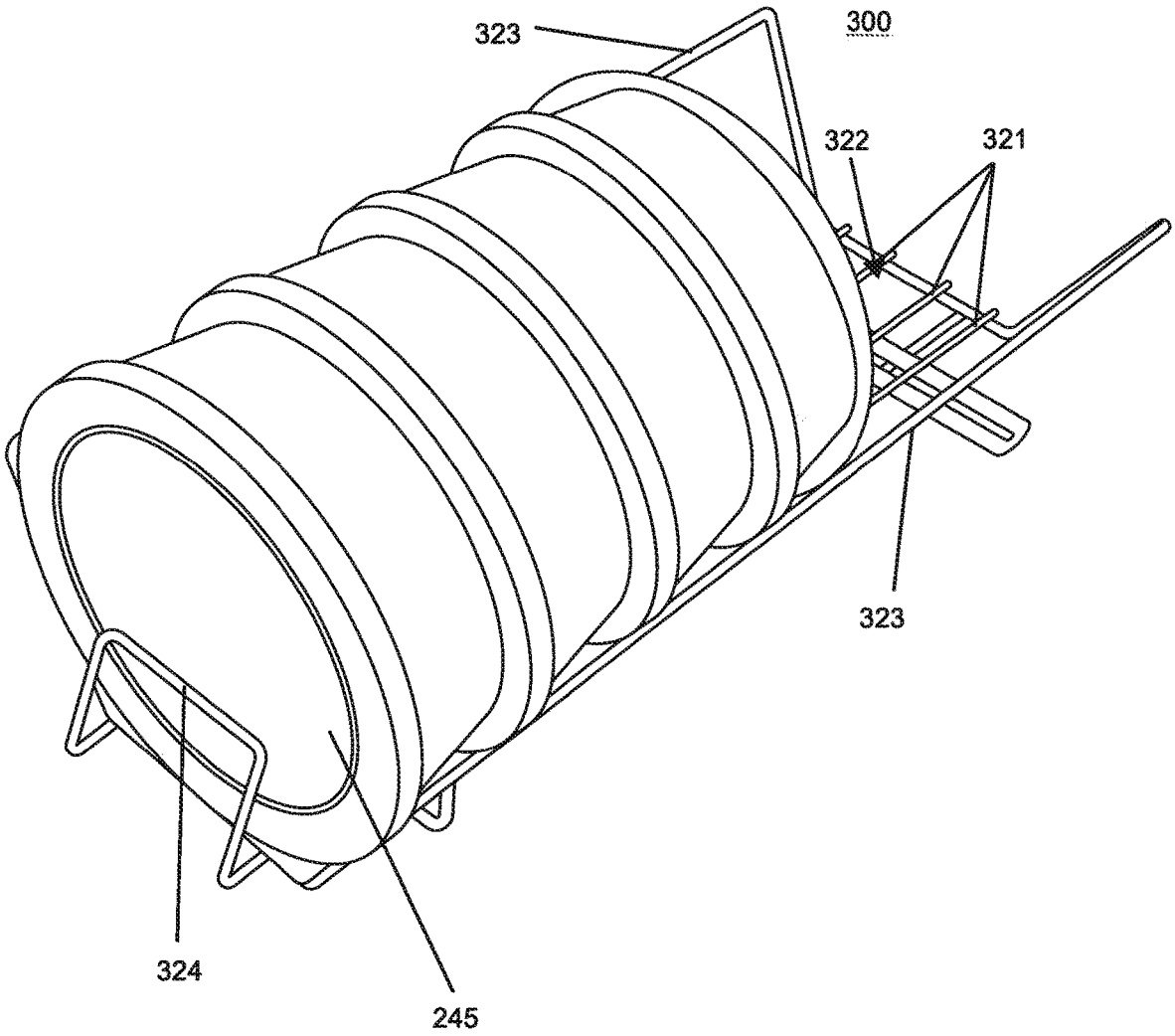
FIG. 15 is a perspective view of a cylindrical front facing package display module.
Figure 16:
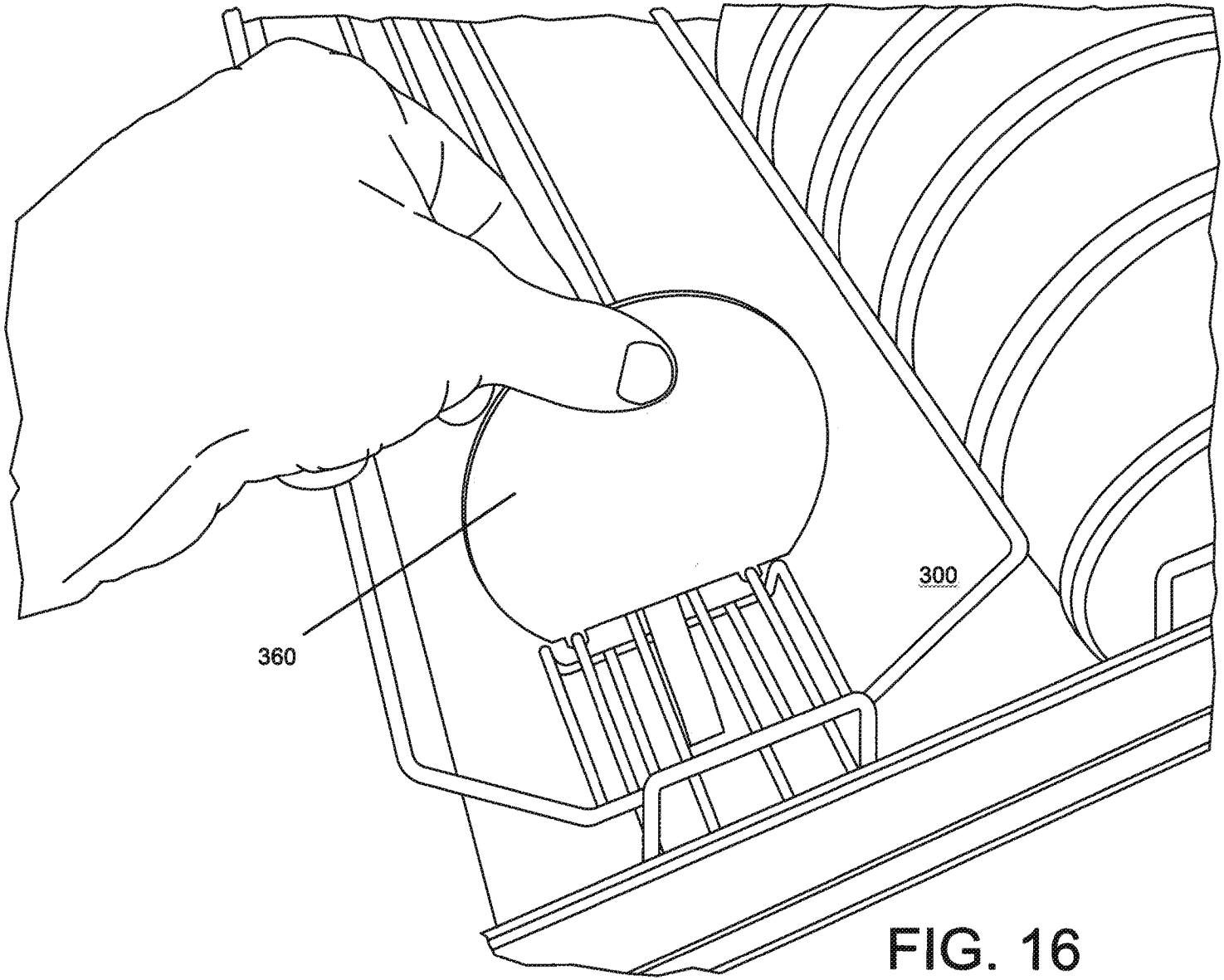
FIG. 16 is a close-up of a package pusher element.
Figure 17:
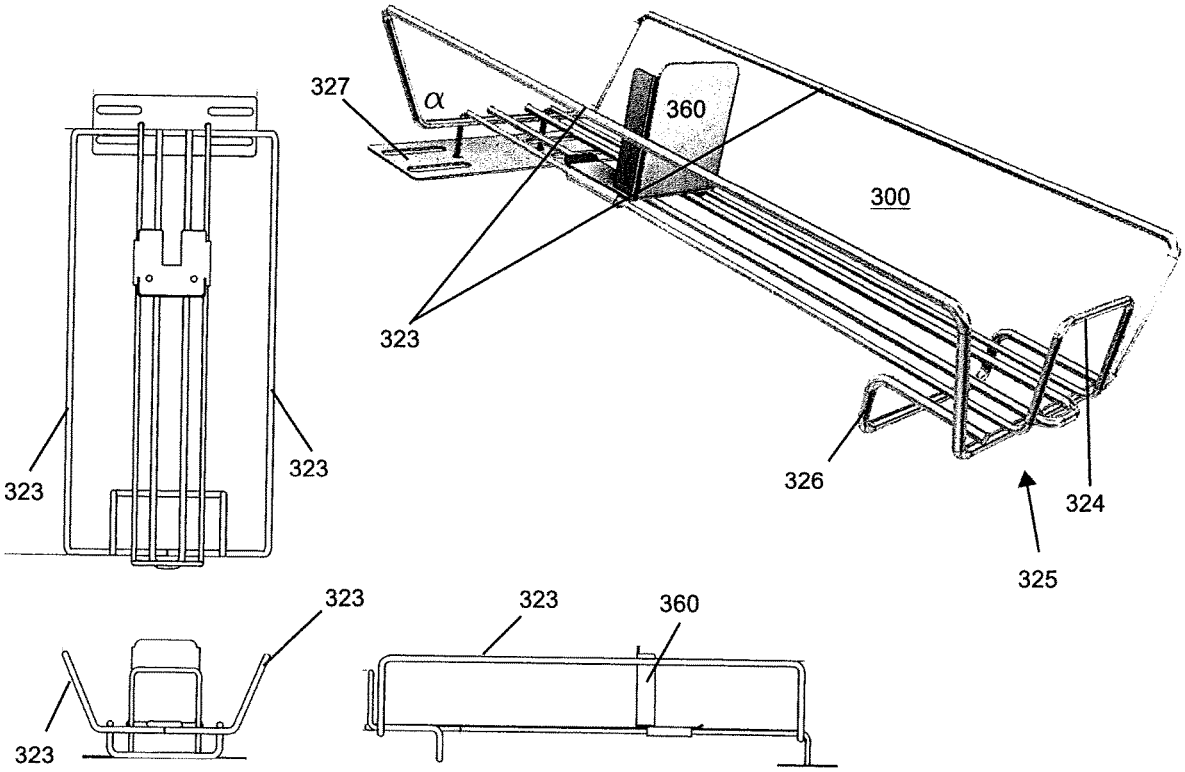
FIG. 17 provides a plurality of views of the module of FIG. 15 with the product removed.

With reference now to FIGS. 15-17, a forward-facing cylindrical tape product display module ("FCPM") 300 is illustrated. The FCPM module 300 can include a plurality of wire frame members 321 forming a planar support surface 322 which underlies and supports the product 245. In addition, a pair of wire frame arms 323 extend from each edge of the planar support surface 322 at an obtuse angle α. A retention flange 324 is formed at a forward edge 325 of the FCPM module 300 to retain the cylindrical forward-facing tape product 245. In some embodiments, and with reference to FIG. 15, a generally round spring-loaded pusher element 360 can be included for use in association with forward facing cylindrical products 245.

As indicated, the shelves 206 can have a generally horizontal orientation wherein the pusher elements such as pusher element 260 or 360, may be particularly advantageous to move product forward on the shelves 206. Alternatively, the shelves 206 may have a slight downward incline allowing gravity to encourage a tape product on the display system 200 to orient forward.

With further reference to FIG. 17, it may be desirable in certain applications to provide the display modules, including but not limited to FCPM module 300 with a front leg 326 which is shorter than a rear leg 327. That is, a front leg 326 and rear leg 327, may be provided on other modules such as modules 220. Moreover, in an embodiment where the shelves 206 have a downwardly inclined orientation, the cantilever legs 326 and 327 on modules displaying products can orient the planar support surface horizontally or even slightly upward notwithstanding the inclined nature of the shelf 206. In this manner, the product packaging which displays literature/advertisement is more readily visible to a potential purchaser. This configuration may be most beneficial in modules 220 configured for forward facing product placement.

An exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. An adjustable merchandising shelf system for dispensing retail products, the system comprising: a fixed portion comprising a first outer mounting assembly, a second outer mounting assembly connected to the first outer mounting assembly by a shelf, and mounting hooks provided at rear sides of the first outer mounting assembly and the second outer mounting assembly, wherein the mounting hooks are configured to be mountable to retail aisle uprights;

the system further comprising at least y modules, each module including a plurality of integrally interconnected frame channels wherein y>x;

said modules comprising at least first modules including channels of a first width and second modules including channels of a second width;

at least several of said modules including reversible generally U-shaped inserts configured for insertion into said channels, said U-shaped inserts providing a first open orientation suitable for receiving a generally cylindrical tape product and a second closed orientation suitable for supporting a rectangular or other flat sided tape product;

said display optionally further including removable spring loaded sliders configured for disposition in at least several of the channels, at least one cabinet configured for mounting to said stand, and at least one module including a relatively long front leg and a relatively short rear leg.

2. A display for tape products comprising at least x shelves disposed on a stand;

at least y modules, each module including a plurality of interconnected frame channels wherein y>x;

said modules comprising at least first modules including channels of a first width and second modules including channels of a second width;

at least several of said modules including reversible generally U-shaped inserts configured for insertion into said channels, said U-shaped inserts providing a first open orientation suitable for receiving a generally cylindrical tape product and a second closed orientation suitable for supporting a rectangular tape product;

said display optionally further including removable spring loaded pusher elements is configured for disposition in at least several of the channels, at least one cabinet configured for mounting to said stand, and at least one channel module including a relatively long front leg and a relatively short rear leg.

3. The display of claim 2 wherein at least a plurality of said modules include a mating recess providing engagement between adjacent modules.

4. The display of claim 3 wherein each module includes only one mating recess.

5. The display of claim 2 wherein each module is comprised of wire framing.

6. The display of claim 2 wherein said shelves are configured for removable attachment to a hanger bar.

7. The display of claim 2 wherein said storage cabinet is configured for removable attachment to a hanger bar.

8. The display of claim 2 wherein at least one of said modules comprises a longer front leg than a rear leg, or no rear leg, such that a plane defined by the main body of said module is upwardly inclined relative to an associated shelf.

9. The display of claim 2 wherein said shelves reside in a substantially horizontal plane or are oriented about 10° or less downward.

10. The display of claim 2 wherein said shelves reside in a substantially horizontal plane or are oriented about 10° or greater downward.

11. The display of claim 2 wherein at least several modules include side and front rails having a height less than a width of the channels of the module.

12. The display of claim 11 wherein said front rails have a height less than said side rails.

13. The display of claim 2 wherein at least one module includes a plurality of coplanar wire elements disposed generally horizontally and at least one wire element on each side extending therefrom at an obtuse angle.

14. The display of claim 13 further including a front end stopper element extending perpendicularly or acutely to the coplanar wire elements.

15. The display of claim 2 wherein said first modules and said second modules are of a substantially equal width.

16. The display of claim 15 further comprising at least third and fourth modules of a substantially equal width to the first and second modules.

17. The display of claim 2 wherein at least one pusher element includes a generally circular product engagement surface.

18. The display of claim 2 wherein at least several modules are comprised of a wire frame first edge and a sheet metal second edge.

19. The display of claim 18 wherein the second edge includes a flange configured to receive the first edge of an adjacent module.

20. An adjustable merchandising shelf system for displaying and storing retail products, the system comprising: a plurality of interchangeable modules, each module including at least one interconnected frame channel, a first side wire edge and a flange portion located on an opposed second side, wherein the flange portion comprises a flange channel configured to engage a first side wire edge of an adjacent module, a reversible generally U-shaped insert configured for insertion into the at least one channel, said U-shaped insert providing a first open orientation suitable for receiving a generally cylindrical product and a second closed orientation suitable for supporting a rectangular or other flat sided tape product.

* * * * *